US007371025B2

(12) United States Patent
Naruse et al.

(10) Patent No.: US 7,371,025 B2
(45) Date of Patent: May 13, 2008

(54) PRINTER

(75) Inventors: Mutsumi Naruse, Asaka (JP); Yukitaka Takeshita, Asaka (JP)

(73) Assignee: FUJIFILM Corporation, Tokyo (JP)

( * ) Notice: Subject to any disclaimer, the term of this patent is extended or adjusted under 35 U.S.C. 154(b) by 308 days.

(21) Appl. No.: 11/091,506

(22) Filed: Mar. 29, 2005

(65) Prior Publication Data

US 2006/0221162 A1 Oct. 5, 2006

(30) Foreign Application Priority Data

Mar. 29, 2004 (JP) ..... 2004-094953

(51) Int. Cl.
*B41J 13/00* (2006.01)
*B65H 3/24* (2006.01)
*B65H 3/40* (2006.01)

(52) U.S. Cl. ..... 400/628; 400/624; 400/625

(58) Field of Classification Search ..... None
See application file for complete search history.

(56) References Cited

U.S. PATENT DOCUMENTS 1,150,210 A * 8/1915 Langston ..... 271/143
1,797,692 A * 3/1931 Moritz ..... 271/143
3,675,918 A * 7/1972 Henc et al. ..... 271/143

FOREIGN PATENT DOCUMENTS

JP 59014007 A * 1/1984
JP 63097537 A * 4/1988
JP 2002-221761 A 8/2002

* cited by examiner

*Primary Examiner*—Daniel J. Colilla
(74) *Attorney, Agent, or Firm*—Sughrue Mion, PLLC

(57) ABSTRACT

The present invention provides a low-profile printer. The printer has a claw installed on a plane which face an exposure surface of an instant film sheet, a single-rotation cam which completes a sequence of operations, and a three-rotation cam which rotates three times while the single-rotation cam makes a single rotation. The claw is equipped with a holding section which extends to the rear end, in the transport direction, of one of instant film sheets and holds the rear end of the instant film sheet. The raking motion of the claw is caused by the three-rotation cam.

2 Claims, 20 Drawing Sheets

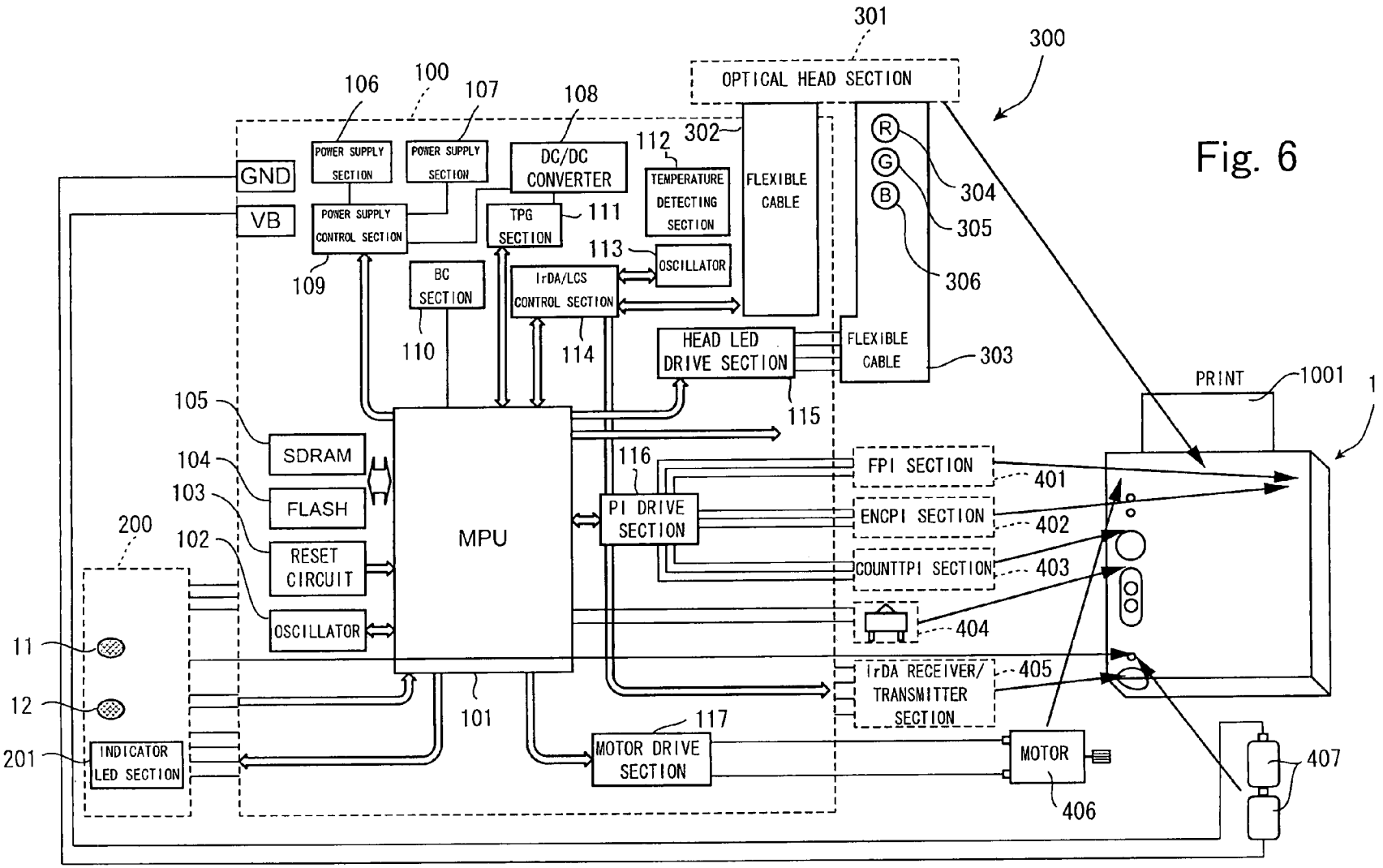
Fig. 6
1
1001
PRINT
407
300
301
OPTICAL HEAD SECTION
304
305
306
303
R
G
B
FLEXIBLE CABLE
401
402
403
404
405
406
MOTOR
FPI SECTION
ENCPI SECTION
COUNTTPI SECTION
IrDA RECEIVER/ TRANSMITTER SECTION
FLEXIBLE CABLE
115
HEAD LED DRIVE SECTION
302
TEMPERATURE DETECTING SECTION
OSCILLATOR
112
113
116
PI DRIVE SECTION
117
MOTOR DRIVE SECTION
108
DC/DC CONVERTER
111
TPG SECTION
IrDA/LCS CONTROL SECTION
114
MPU
101
107
POWER SUPPLY SECTION
100
BC SECTION
110
106
POWER SUPPLY SECTION
POWER SUPPLY CONTROL SECTION
109
GND
VB
SDRAM
FLASH
RESET CIRCUIT
OSCILLATOR
105
104
103
102
200
INDICATOR LED SECTION
11
12
201

PRINTER

BACKGROUND OF THE INVENTION

1. Field of the Invention

The present invention relates to a printer which records images on a recording medium by writing the images on the recording medium on which the images are to be recorded, while transporting the recording medium in a predetermined transport direction.

2. Description of the Related Art

Printers are known which record images on instant film sheets. Such printers are equipped with a media pack compartment to be loaded with an instant film pack containing multiple instant film sheets stacked together. Also, a claw is installed on a side of the media pack compartment to hold the rear end, in a transport direction, of one of the instant film sheets loaded in the media pack compartment and rake up the instant film sheet in the transport direction. Furthermore, a mechanical section including cams is installed on a side of the media pack compartment to cause the raking motion of the claw.

An image is recorded on an instant film sheet as follows: the first one of the instant film sheets in the media pack compartment is raked up at the rear end by the claw through rotation of the cam and the like, transported by a transport rollers, and irradiated cyclically with lights from light-emitting elements with red (R), green (G), and blue (B) luminescent colors to write a latent image, and then a developer pool of the instant film sheet is squeezed by distribution rollers to distribute a developer (e.g., Japanese Patent Application Laid-open No. 2002-221761).

As described above, conventional printers have a mechanical section including a claw and cams which are installed on a side of the media pack compartment. The amount of raking movement of the claw (travel distance of the claw) is relatively large, and the cams and the like in the mechanical section have sufficiently large sizes accordingly. This makes it difficult to reduce the size of the printers.

SUMMARY OF THE INVENTION

The present invention has been made in view of the above circumstances and provides a low-profile printer.

To achieve the above object, the present invention provides a printer which records images on a recording medium by writing the images on the recording medium on which the images are to be recorded, while transporting the recording medium in a predetermined transport direction, having:

a media pack compartment loaded with a media pack which contains multiple sheets of the recording medium stacked together;

a claw which holds the rear end, in a transport direction, of a sheet of the recording medium loaded in the media pack compartment, rakes up the sheet of the recording medium in the transport direction, and returns to an original waiting position; and a transport roller which takes over transport of the recording medium raked up by the claw;

wherein the claw is installed on a plane which faces a surface of the recording medium contained in the media pack loaded in the media pack compartment and is equipped with a holding section which extends from the plane at the rear end, in the transport direction, of the sheet of the recording medium loaded into the media pack compartment and holds the rear end of the sheet of the recording medium.

Since the printer according to the present invention is equipped with the claw installed on a plane which faces a surface of the recording medium contained in the media pack loaded in the media pack compartment and the claw has a holding section which extends at the rear end, in the transport direction, of the sheet of the recording medium and holds the rear end of the sheet of the recording medium, the mechanical section including cams which has a relatively large area to allow for the raking motion of the claw can be installed on the plane which faces the recording medium. This reduces the thickness of the printer compared to the conventional technique of installing a mechanical section including a claw and cams on a side of the media pack compartment.

Preferably, the printer has a single-rotation cam which is installed on the same side as the plane and completes a sequence of transport operations by a single rotation and a multi-rotation cam which rotates multiple times while the single-rotation cam makes a single rotation, wherein the raking motion of the claw is caused by the multi-rotation cam.

If the raking motion of the claw is caused by one rotation of the cam, the required amount of raking movement must be provided by a small rotational angle, resulting in a low drive efficiency. Consequently, the mechanical section which causes the raking motion of the claw requires relatively large power as well as mechanical strength. If the raking motion of the claw is caused by a multi-rotation cam which rotates multiple times while the single-rotation cam makes a single rotation to perform a sequence of operations, it is possible to use a relatively large rotational angle for the raking motion of the claw. In that case, the mechanical section which causes the raking motion of the cam requires relatively small power, making it possible to reduce the size of the mechanical section.

Also, preferably, the printer has a ratchet type counter which is installed on the same side as the plane and counts up in synchronization with movement of the claw or the multi-rotation cam.

This makes it easy to implement a mechanical counter which can display the number of remaining sheets of the recording medium in large numeric characters.

Since the printer according to the present invention is equipped with the claw installed on a plane which faces a surface of the recording medium contained in the media pack loaded in the media pack compartment and the claw has a holding section which extends at the rear end, in the transport direction, of the sheet of the recording medium and holds the rear end of the sheet of the recording medium, it is possible to reduce the thickness of the printer.

BRIEF DESCRIPTION OF THE DRAWINGS

FIG. 6 is a block diagram showing a control system in the printer;

DETAILED DESCRIPTION OF THE INVENTION

An embodiment of the present invention will be described below.

Figure 1:
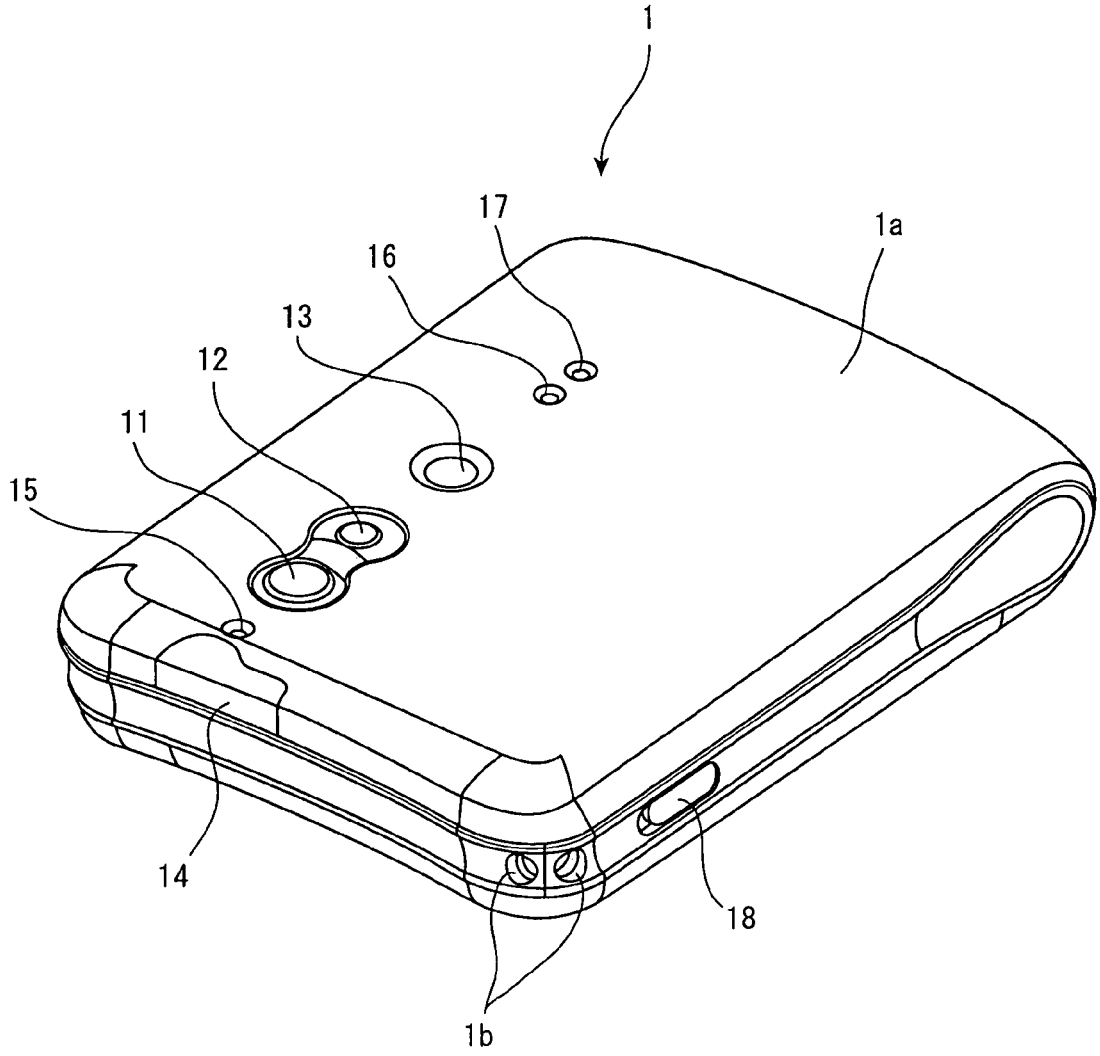
FIG. 1 is a perspective view of a printer according to an embodiment of the present invention as viewed obliquely from the front.

FIG. 1 is a perspective view of a printer according to an embodiment of the present invention as viewed obliquely from the front.

The printer 1 is used in combination with a cell phone or the like. A media pack compartment is loaded with an instant film pack containing a stack of instant film sheets (ten sheets in this case) on which a latent image is formed by exposure and then visualized by a developer during delivery. An instant film sheet is exposed according to image data and the developer is applied to it while the instant film sheet is being sent out. The instant film sheet is an example of the recording medium according to the present invention.

Some cell phones are capable of infrared communication compliant with IRDA (InfraRed Data Association). They can send their own information to other information devices using infrared communication. For example, a camera-equipped cell phone can send image data to the printer 1. Upon receiving image data of images taken by a camera-equipped cell phone or image data attached to mail sent to the cell phone through infrared communication, the printer 1 records images on instant film sheets based on the image data. Furthermore, images based on the received image data can be recorded again on other film sheets by simply pressing a repeat switch (described later) without the trouble of re-transmitting the image data from the cell phone.

As shown in FIG. 1, the printer 1 is a portable printer with a thin, light-weight, and small structure. It contains two 3-volt primary batteries. An instant film pack is loaded in a housing 1*a* of the printer 1 and an image is recorded on each of the ten instant film sheets contained in the instant film pack.

Operation buttons are provided on the top face of the housing 1*a* of the printer 1: a power switch (hereinafter referred to as the power SW) 11 used to turn on and off the printer 1 and a repeat switch (hereinafter referred to as the repast SW) 12 used to re-record images based on transmitted image data. Also, a counter 13 which indicates the number of remaining instant film sheets is provided on the top face of the housing 1*a*. The counter 13 is a mechanical one which displays a numeric value of "10" when a new instant film pack is loaded, indicating that the number of remaining instant film sheets is 10. Subsequently, the number is decremented by one each time an image is recorded on an instant film sheet until an image is recorded on the tenth instant film sheet, and a numeric value of "0" is displayed indicating that the number of remaining instant film sheets is 0. Incidentally, when the instant film pack is pulled out, the counter 13 becomes blank, displaying nothing.

An end of the printer 1 is equipped with a receiver/transmitter section 14 which receives image data transmitted through the infrared communication and sends a signal notifying the partner about the reception.

Furthermore, the housing 1*a* of the printer 1 is equipped with a power LED 15 which glows when the printer 1 is turned on and blinks during infrared communication, communications error LED 16 which glows in case of error in infrared communication, and a low-battery indicator LED 17 which glows when the built-in batteries get low, prompting the user to replace the batteries.

Also, a film door opening switch 18 is provided on a flank of the printer 1 to open a film door (described later) installed on the underside of the printer 1 while a strap mount 1*b* is provided at a corner.

Figure 2:
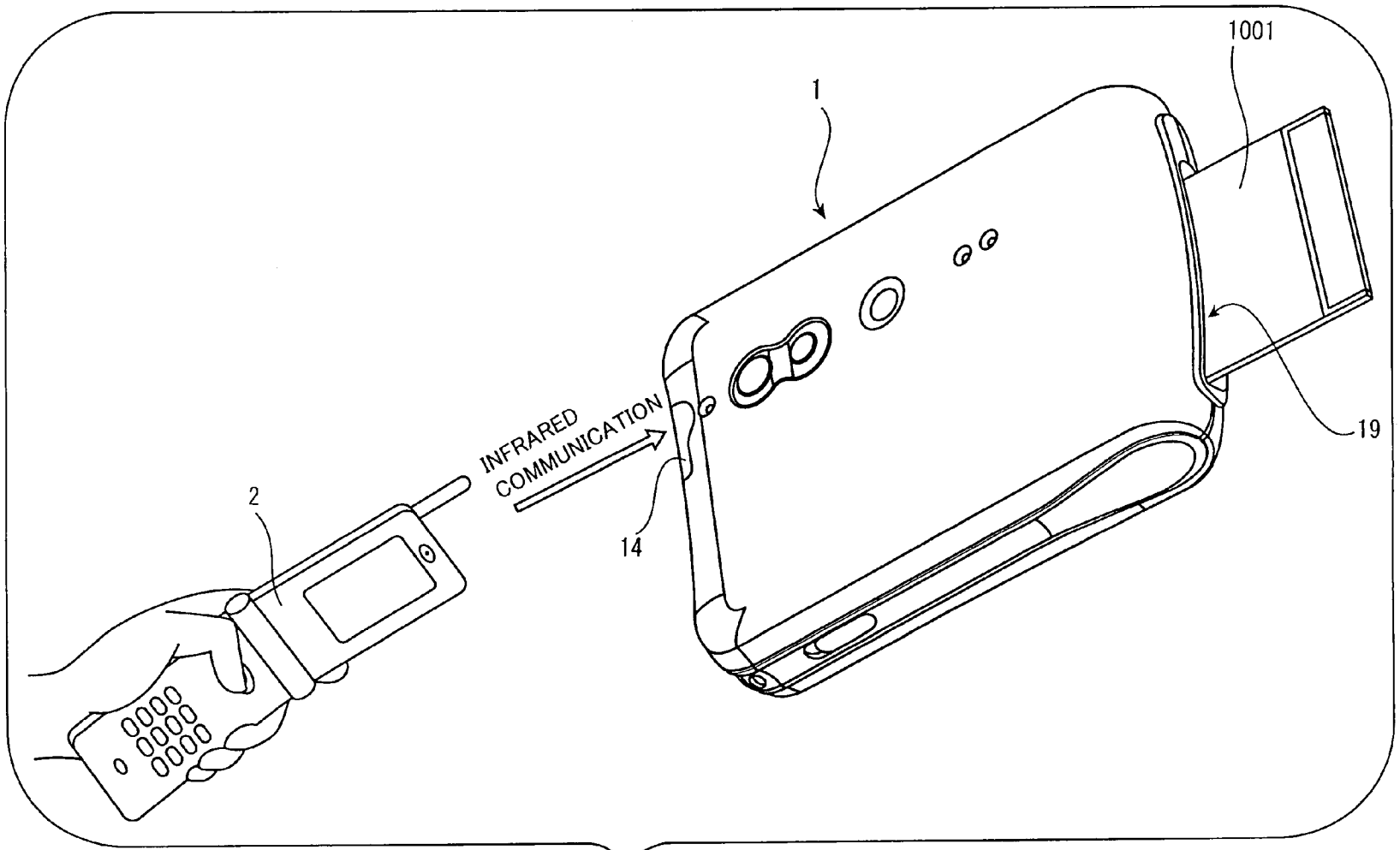
FIG. 2 is a diagram showing how the printer shown in FIG. 1 ejects an instant film sheet on which an image is recorded based on image data received from a camera-equipped cell phone.

FIG. 2 is a diagram showing how the printer shown in FIG. 1 ejects an instant film sheet on which an image is recorded based on image data received from a camera-equipped cell phone.

With an infrared communications section of a camera-equipped cell phone 2 directed at the receiver/transmitter section 14, the user operates the camera-equipped cell phone 2 to send image data of an image taken by the camera-equipped cell phone 2 to the printer 1 through infrared communication. The printer 1 receives the image data transmitted through infrared communication, records a latent image based on the received image data on an instant film sheet 1001 by exposure, develops the instant film sheet 1001, and ejects the instant film sheet 1001 gradually through an output port 19 of the printer 1. Subsequently, if the repeat SW 12 is pressed, the same image is re-recorded on another instant film sheet.

Figure 3:
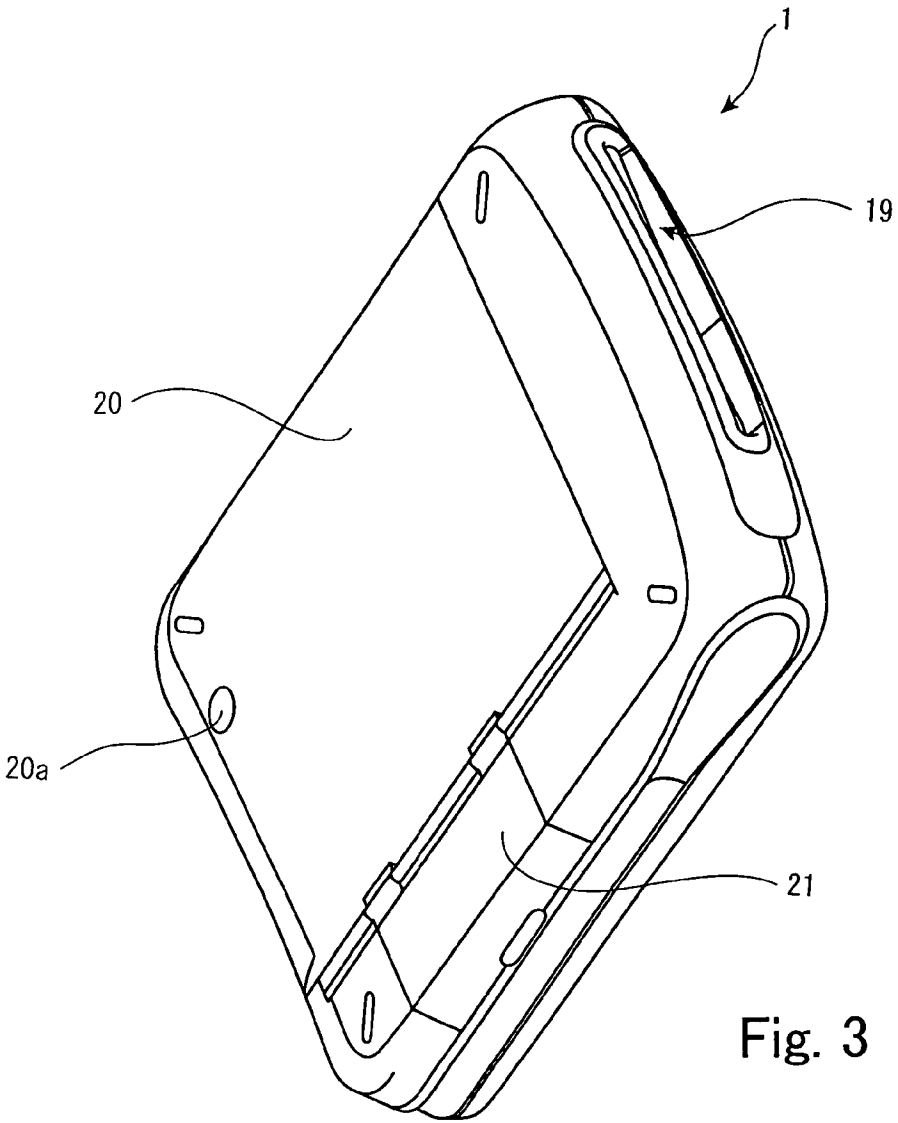
FIG. 3 is a perspective view of the underside of the printer in FIG. 1 as viewed obliquely from above.

FIG. 3 is a perspective view of the underside of the printer in FIG. 1 as viewed obliquely from above.

On the underside of the printer 1, there is a film door 20 which is opened by means of the film door opening switch 18 shown in FIG. 1. An instant film pack is loaded in the media compartment through the opened film door 20. Also, a pack confirmation window 20*a* is provided on the film door 20 to check whether an instant film pack has been loaded. Besides, a battery lid 21 is provided next to the film door 20. It is opened to mount batteries which supply power to the printer 1.

Figure 4:
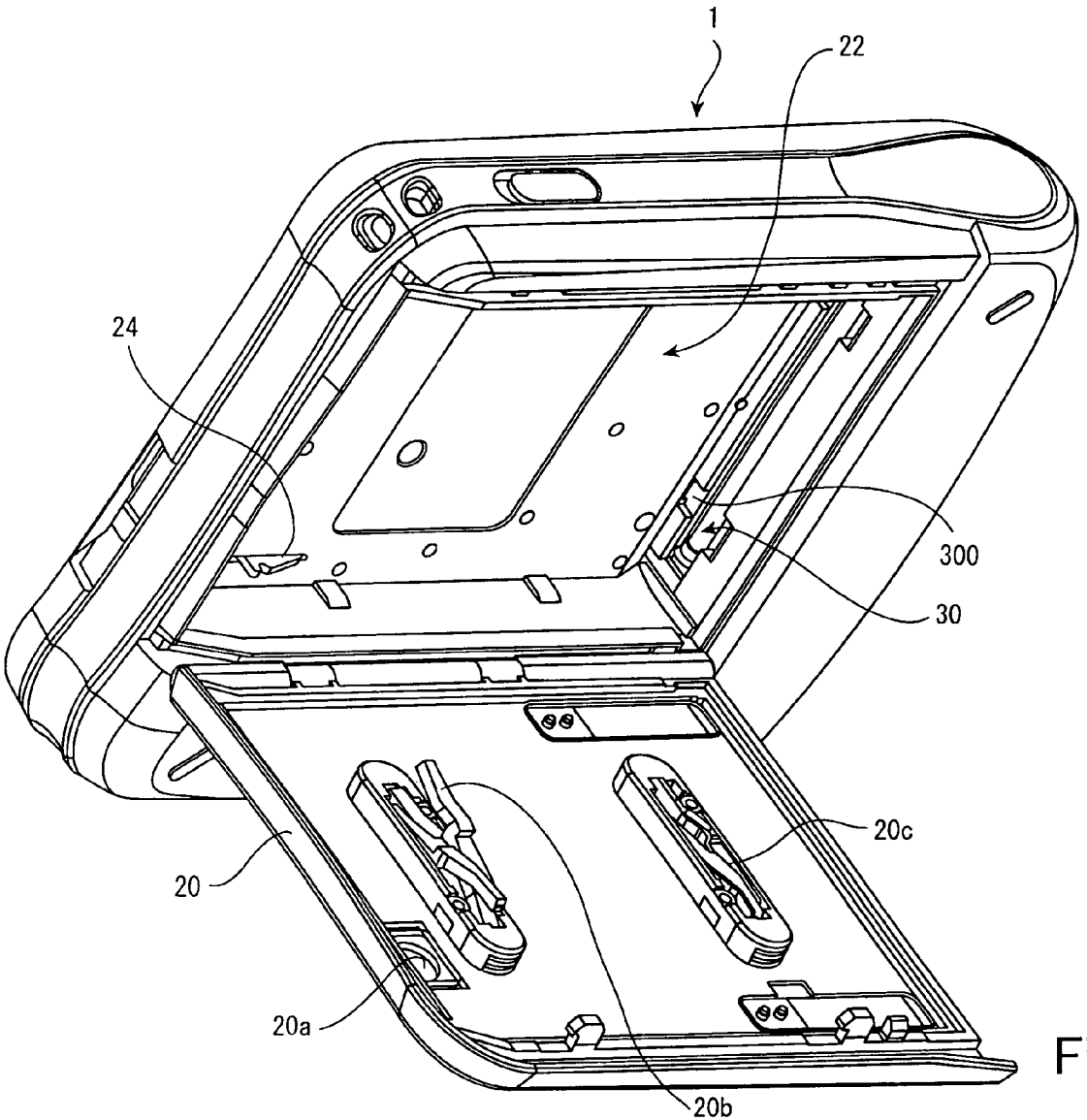
FIG. 4 is a perspective view of the printer in FIG. 3 with its film door open.

FIG. 4 is a perspective view of the printer in FIG. 3 with its film door open.

In addition to the pack confirmation window 20*a* described above, spring members 20*b* and 20*c* are provided on the inner side of the film door 20 to press the instant film sheets stacked in the instant film pack to the top face of the printer 1.

The printer 1 is equipped with a media pack compartment 22 to be loaded with an instant film pack. Outside the pack compartment 22, in a right part of FIG. 4, there are an image write section 300 which writes an image onto an instant film sheet being transported and a media transport/developer distribution section 30. Details of the image write section 300 and media transport/developer distribution section 30 will be described later. In the media pack compartment 22, in a lower part of FIG. 4, there is a claw 24 for use to send out instant film sheets to the image write section 300 and media transport/developer distribution section 30. Incidentally, details of the claw 24 will be described later. With this configuration, the uppermost one of the instant film sheets in the instant film pack is raked up by the claw 24 and transported by the media transport/developer distribution section 30, and in the meantime an image is recorded on it by the image write section 300 and developed.

Figure 5:
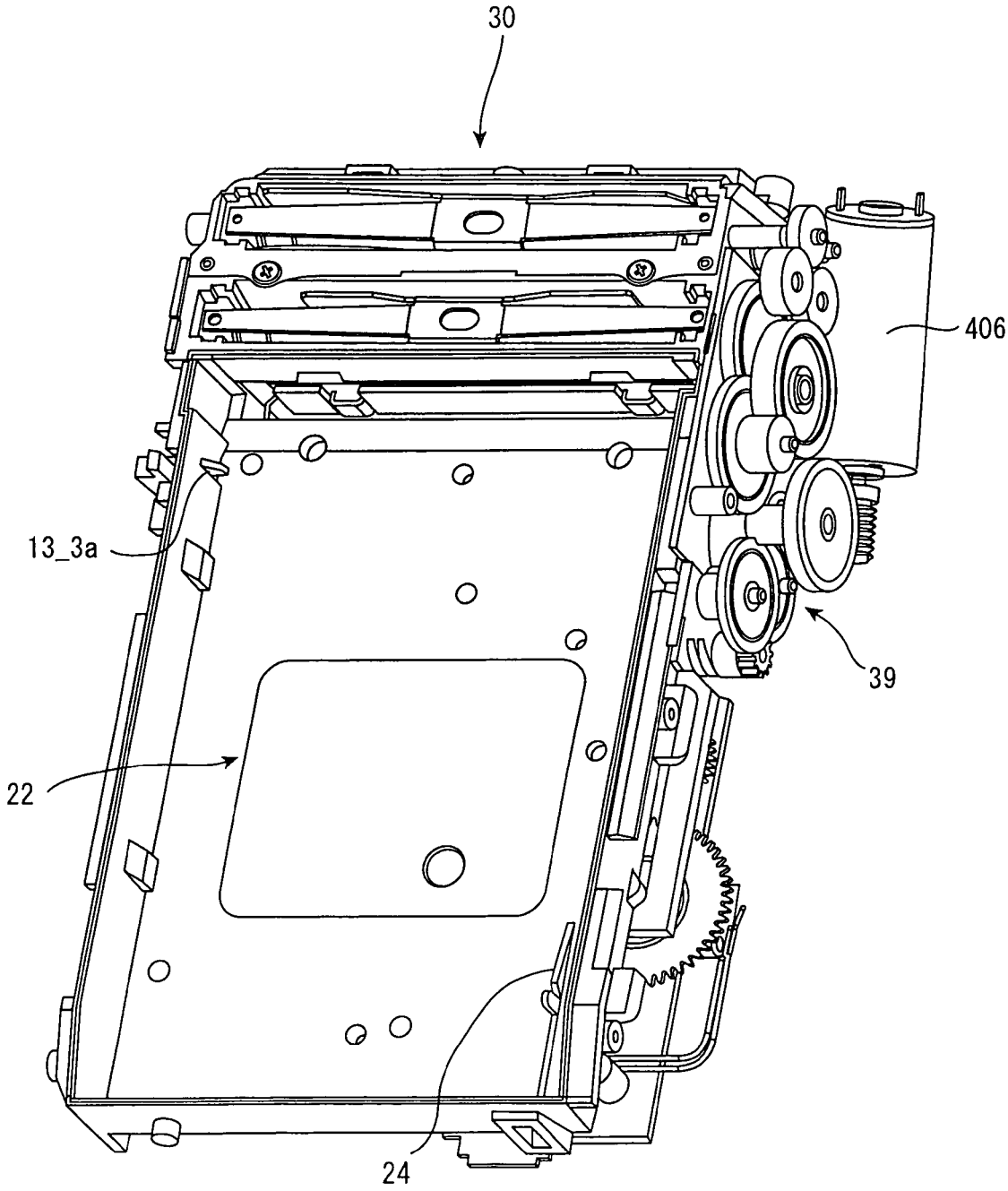
FIG. 5 is a perspective view of the printer in FIG. 4 with its housing removed.

FIG. 5 is a perspective view of the printer in FIG. 4 with its housing removed.

FIG. 5 shows a DC motor 406 as well as the media transport/developer distribution section 30 equipped with a gear train 39 which transmits the rotational drive force of the DC motor 406 to transport rollers and distribution rollers described later. FIG. 5 also shows the claw 24 installed in the media pack compartment 22 as well as a rib 13_3*a* of a counter lever pressed when an instant film pack is loaded.

FIG. 6 is a block diagram showing a control system in the printer.

The entire area of FIG. 6 shows a configuration of the control system of the printer 1 which schematically shows the printer 1 shown in FIG. 1. Incidentally, the arrows in FIG. 6 indicate relative locations of components of the control system of the printer 1. The right end of FIG. 6 shows a diagram of the printer corresponding to that in FIG. 2.

The printer 1 has a main board 100, a sub-board 200, the image write section 300, an FPI section 401, an ENCPI section 402, a COUNTPI section 403, a cam switch 404, an IrDA receiver/transmitter section 405 installed in the receiver/transmitter section 14 described earlier, and the DC motor 406 described above.

The sub-board 200 contains the power SW 11 and repeat SW 12 described above as well as an indicator LED section 201. The indicator LED section 201 includes the power LED 15, communications error LED 16, and low-battery indicator LED 17 described above as well as a counter backlight LED (not shown) mounted on the backside of the counter 13.

The image write section 300 includes an optical head section 301 equipped with an optical guide, liquid crystal shutter (LCS), etc.; flexible cables 302 and 303 which connect the optical head section 301 with the main board 100; and red (R), green (G), and blue (B) light-emitting elements (LED) 304, 305, and 306 mounted on the flexible cable 303. The image write section 300 writes a latent image on an instant film sheet being transported, by irradiating it with three color lights from the LEDs 304, 305, and 306 cyclically in synchronization with write command pulses based on image data received by the receiver/transmitter section 14. The printer 1 contains two 3-volt primary batteries 407.

The main board 100 will be described below. A 6-volt power supply voltage VB is applied to the main board 100 from the primary batteries 407 connected in series. The main board 100 is equipped with an MPU (micro processor unit) 101, oscillator 102, reset circuit 103, flash memory (FLASH) 104, and SDRAM 105.

The MPU 101 totally controls the operation of the printer 1.

The oscillator 102 generates an oscillatory signal of a predetermined frequency and supplies it as an operation clock signal to the MPU 101.

The reset circuit 103 outputs a reset signal to initialize the MPU 101.

The flashmemory 104 is anon-volatile memory. It stores adjustment values and the like for adjustment of individual differences which vary with the mechanism and the like unique to the printer 1.

The SDRAM 105 is a volatile memory. It stores image data and the like received from the camera-equipped cell phone 2.

The main board 100 is equipped with a power supply section 106, a power supply section 107, and a DC/DC converter 108 which receive the 6-volt power supply voltage VB and output a 2.5-V voltage, 3.3-V voltage, and 15-V voltage, respectively. It is also equipped with a power supply control section 109 which controls the power supply sections 106 and 107 and the DC/DC converter 108 on instructions from the MPU 101. The 2.5-V voltage is supplied to the MPU 101 and the 3.3-V voltage is supplied to peripheral circuits other than the MPU 101. Also, the 15-V voltage is used to drive an LCD.

To prolong the life of the primary batteries 407, the MPU 101 of the printer 1 has a standby mode, which is a power saving mode. Even if the power SW 11 is pressed, the MPU 101 enters the standby mode after initialization is completed. In this state, if infrared communication is conducted from outside, the MPU 101 switches from standby mode to normal operation mode, records an image on an instant film sheet, and switches from normal operation mode to standby mode quickly. Also, when the repeat SW 12 is pressed, the MPU 101 records an image on an instant film sheet and then enters standby mode. The MPU 101 controls the power supply sections 106 and 107 and the DC/DC converter 108 via the power supply control section 109 so that power is supplied to various components only when necessary. This makes it possible to use the printer 1 on the built-in primary batteries 407 for a prolonged period of time.

Furthermore, the main board 100 is equipped with a BC section 110, TPG section 111, temperature detecting section 112, oscillator 113, IrDA/LCS control section 114, and head LED drive section 115.

The BC section 110 checks whether the power supply voltage VB of the built-in primary batteries 407 is lower than a predetermined value. If it is found, based on the results of the check, that the power supply voltage VB of the built-in primary batteries 407 is lower than the predetermined value, the MPU 101 illuminates the low-battery indicator LED 17, prompting the user to replace the batteries.

The TPG section 111 turns on and off the 15-V voltage outputted from the DC/DC converter 108.

The temperature detecting section 112 detests temperature of the image write section 300. The MPU 101 controls the shutter speeds and the like of shutter sections of the liquid crystal shutter in the optical head section 301 based on a detection signal from the temperature detecting section 112.

The oscillator 113 generates an oscillatory signal of a predetermined frequency and supplies it to the IrDA/LCS control section 114.

The IrDA/LCS control section 114 controls the IrDA receiver/transmitter section 405 and optical head section 301 based on the oscillatory signal from the oscillator 113. The IrDA receiver/transmitter section 405 is equipped with a photo-transmitter and photo-receiver, and the IrDA/LCS control section 114 sends data produced by the photo-receiver as a result of photoelectric conversion to the MPU 101 and sends data from the MPU 101 via the photo-transmitter, notifying external devices to that effect. Also, the IrDA/LCS control section 114 controls the liquid crystal shutter of the optical head section 301 via the flexible cable 302 based on instructions from the MPU 101.

The head LED drive section 115 passes current through the LEDs 304, 305, and 306 via the flexible cable 303 based on instructions from the MPU 101, and thereby drives the LEDs 304, 305, and 306.

While feeding an instant film sheet in a predetermined sub-scanning direction (the feed direction of the instant film sheet) using the DC motor 406, the printer 1 according to this embodiment writes to the instant film sheet using three colors of RGB cyclically in the sub-scanning direction on, writes to all pixels arranged in the main scanning direction using the same color simultaneously in the main scanning direction orthogonal to the sub-scanning direction, and thereby records an image on the instant film sheet.

The optical head section 301 of the image write section 300 is supplied with a control signal from the IrDA/LCS control section 114 via the flexible cable 302 according to image data. The control signal controls the shutter speeds of the shutter sections of the liquid crystal shutter in the optical head section 301. The shutter speeds of the shutter sections are controlled according to the image data. Lights corresponding to the RGB colors of the LEDs 304, 305, and 306 mounted on the flexible cable 303 are directed at the instant film sheet, forming a latent image consisting of a large number of light spots (dots) on the instant film sheet along its width. The width direction along which shutter sections are arranged one-dimensionally corresponds to the main scanning direction. Thus, as shutter sections are scanned electronically in the main scanning direction, one line of light spots (all pixels) are recorded on the instant film sheet. That is, through electronic scanning by the optical head section 301, light spots consisting of a large number of dots are recorded in the main scanning direction on the instant film sheet. As described above, according to this embodiment, the instant film sheet is fed in the sub-scanning direction by the DC motor 406. Thus, light spots for a large number of dots are recorded sequentially in the sub-scanning direction as well by the image write section 300.

Furthermore, the main board 100 is equipped with a PI drive section 116, which drives the FPI section 401, ENCPI section 402, and COUNTPI section 403. Now, description will be given of the FPI section 401, ENCPI section 402, and COUNTPI section 403.

The FPI section 401 is a photointerrupter which detects the presence or absence of an instant film sheet.

The ENCPI section 402 is a photointerrupter which outputs an encoder signal consisting of pulse trains synchronized with the rotation of the DC motor 406.

The COUNTPI section 403 is a photointerrupter which detects whether the counter 13 is reset (the instant film pack is pulled out).

Also, the main board 100 is connected with a cam switch 404, which is used to monitor the initial position of a transport mechanism of the printer 1.

Furthermore, the main board 100 is equipped with a motor drive section 117. The motor drive section 117 controls the rotational speed of the DC motor 406 on instructions from the MPU 101 so that the pulse train of the encoder signal outputted from the ENCPI section 402 occurs at predetermined time intervals.

Figure 7:
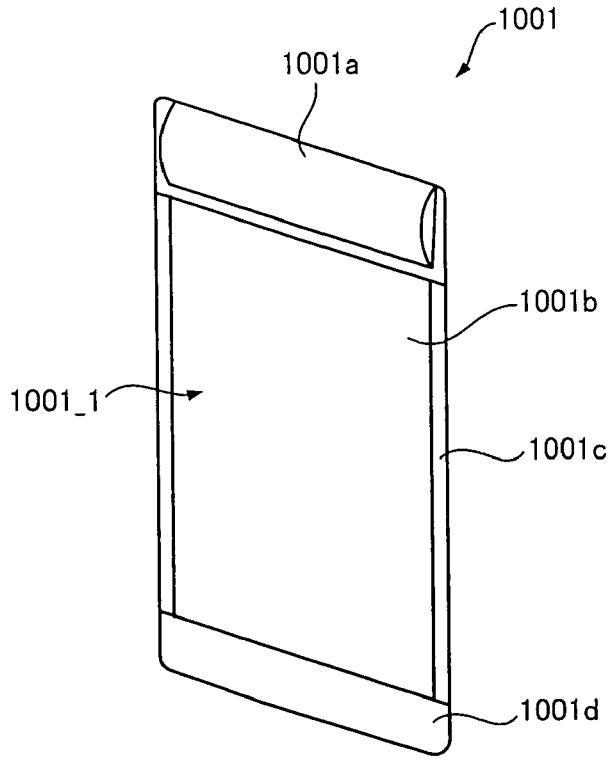
FIG. 7 is a perspective view showing an exposure surface of an instant film sheet.
Figure 8:
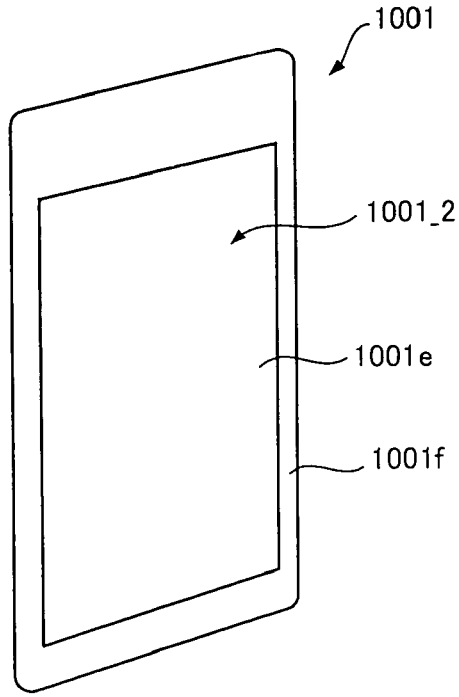
FIG. 8 is a perspective view showing a viewing surface of the instant film sheet.

FIG. 7 is a perspective view showing an exposure surface of an instant film sheet while FIG. 8 is a perspective view showing a viewing surface of the instant film sheet.

FIG. 7 shows an exposure surface 1001_1 of an instant film sheet 1001. The exposure surface 1001_1 has a processing liquid pool 1001*a* which is provided at the front end in the transport direction of the instant film sheet 1001, an exposure section 1001*b* which is exposed to an image, a margin 1001*c*, and a trap 1001*d* which absorbs excess liquid. FIG. 8 shows a viewing surface 1001_2 of the instant film sheet 1001. The viewing surface 1001_2 has a viewing section 1001*e* used to view an image visualized as the developer is distributed after a latent image is formed by exposure. It also has a margin 1001*f*.

Figure 9:
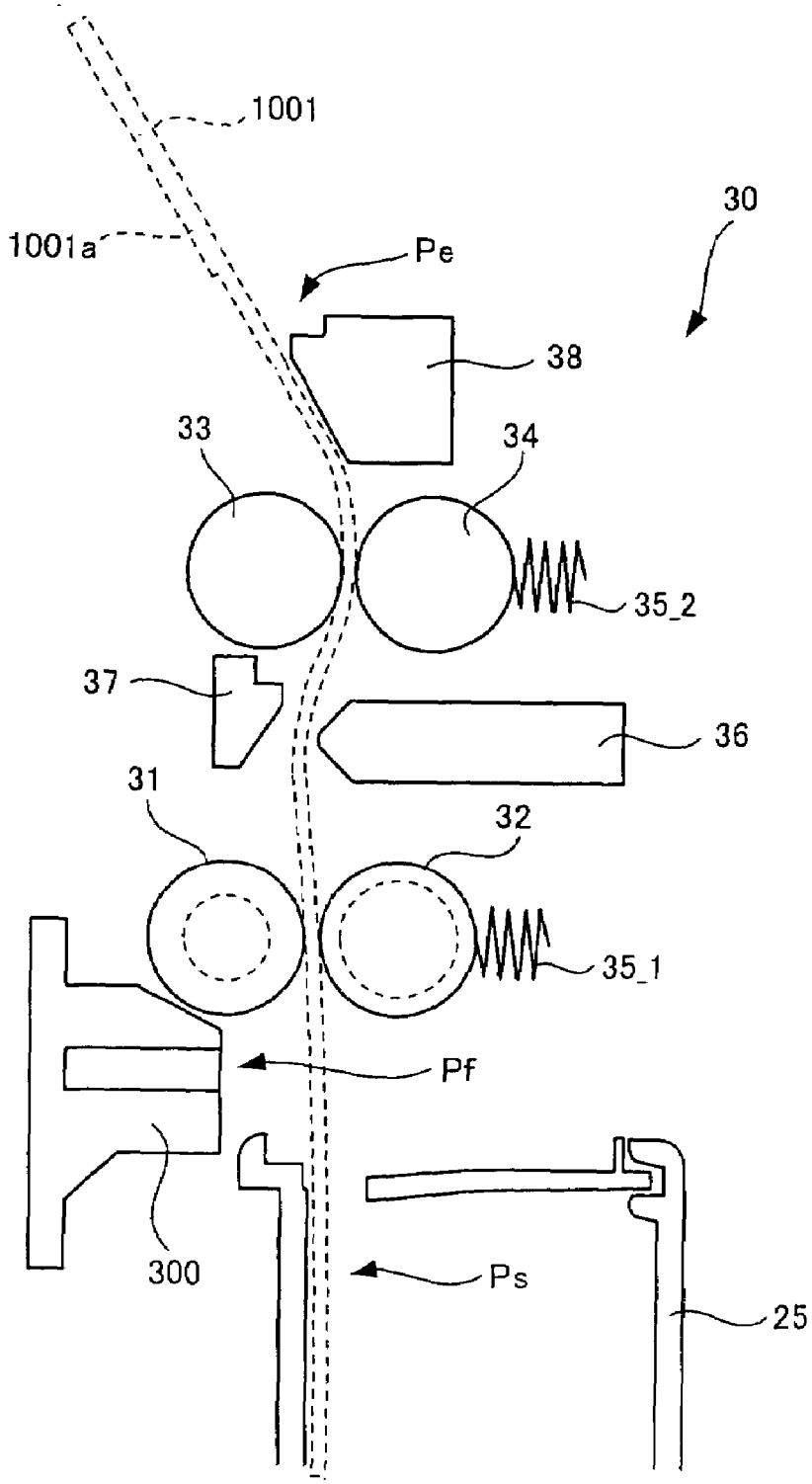
FIG. 9 is a sectional view of a media transport/developer distribution section.

FIG. 9 is a sectional view of the media transport/developer distribution section.

The media transport section 30 is equipped with a pair of transport rollers 31 and 32 to transport an instant film sheet 1001 by holding it from both sides. The transport roller 32 is urged toward the transport roller 31 by a spring member 35_1.

Also, downstream of the pair of transport rollers 31 and 32 in the transport direction of the instant film sheet 1001, the media transport section 30 is equipped with a pair of distribution rollers 33 and 34 to distribute a developer by holding the instant film sheet 1001 across its width and squeezing a processing liquid pool 1001*a*. The distribution roller 34 is urged toward the distribution roller 33 by a spring member 35_2.

Furthermore, between the pair of transport rollers (31 and 32) and the pair of distribution rollers (33 and 34), the media transport section 30 is equipped with control plates 36 and 37 which control the developer being distributed as well as with a guide frame 38 which guides the instant film sheet 1001. Besides, the image write section 300 is installed near an exit of the instant film pack 25.

The printer 1 according to the present embodiment rakes up the uppermost one of the instant film sheets 1001 in the instant film pack 25 from a predetermined transport start point Ps using the claw 24 (see FIGS. 4 and 5; details will be described later) and starts to write an image onto the instant film sheet 1001 at a fixed write point Pf using the image write section 300 while the instant film sheet 1001 is being transported by the transport rollers 31 and 32. Furthermore, while writing the image onto the instant film sheet 1001, the printer 1 transports the instant film sheet 1001 using the transport rollers 31 and 32, distributes the processing liquid by squeezing a processing liquid pool 1001*a* using the distribution rollers 33 and 34, develops the instant film sheet 1001 by controlling the distributed processing liquid using the control plates 36 and 37, and then transports the instant film sheet 1001 to a predetermined transport end point Pe. An image is recorded on each instant film sheet 1001 in this way.

Figure 10:
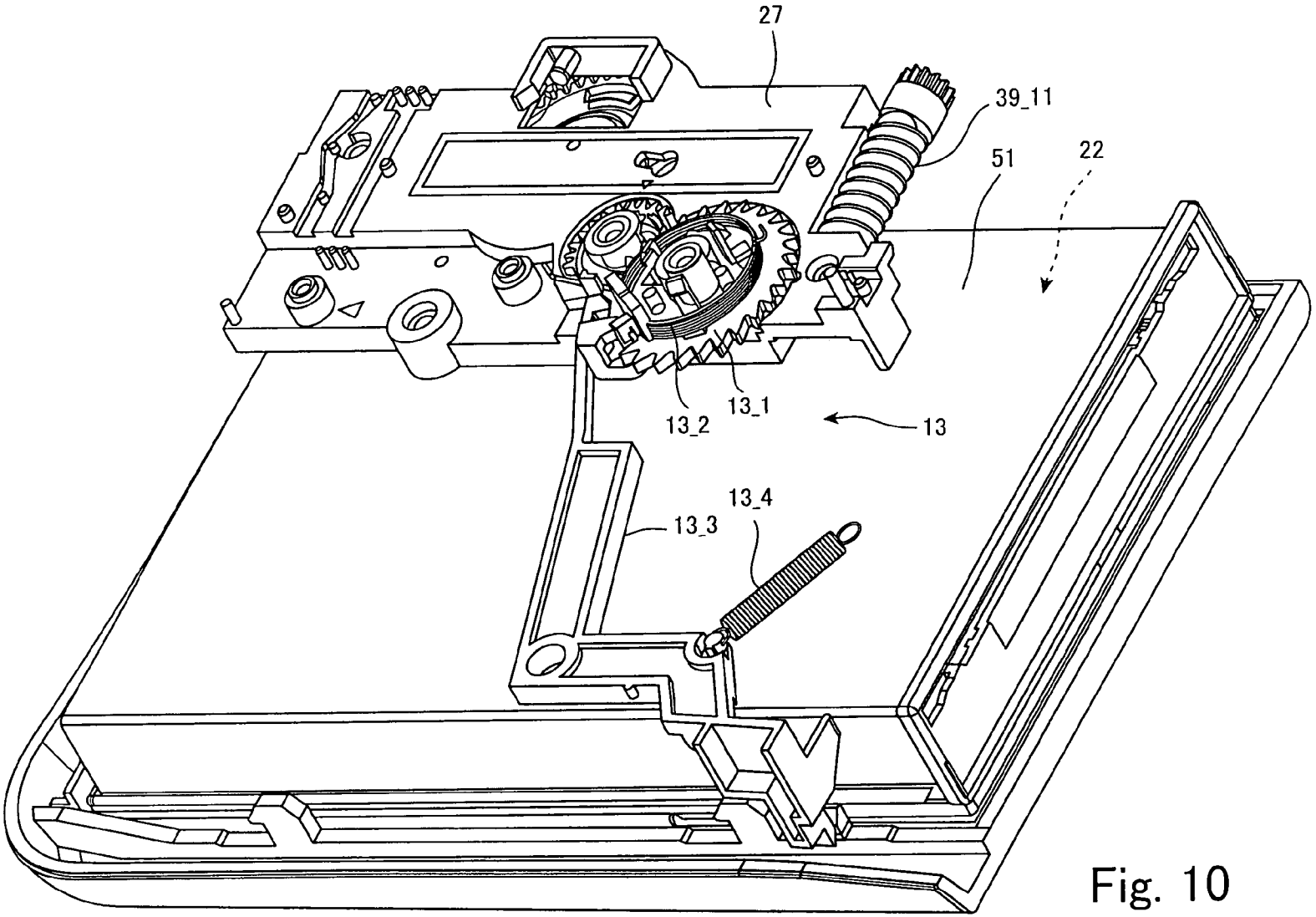
FIG. 10 is a perspective view of the printer according to this embodiment with a housing removed as viewed from the front side.
Figure 11:
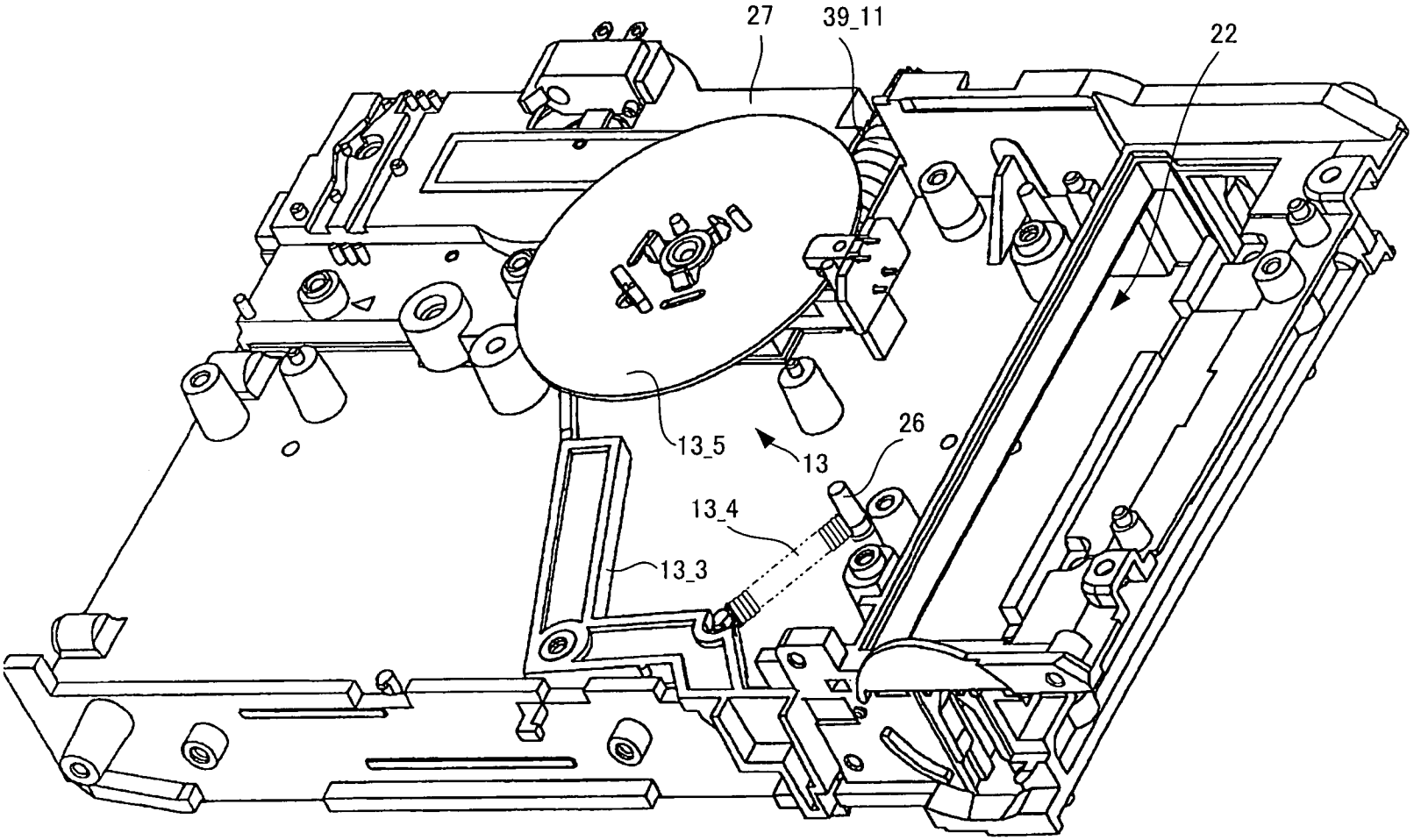
FIG. 11 is a perspective view of the printer in FIG. 10 with a character plate attached.

FIG. 10 is a perspective view of the printer according to this embodiment with a housing removed as viewed from the front side. FIG. 11 is a perspective view of the printer in FIG. 10 with a character plate attached.

The printer 1 has a casing 51 which contains the media pack compartment 22 as well as a cover member 27 and counter 13 which are mounted on the casing 51.

The counter 13 is a ratchet type which counts up in synchronization with movement of the claw 24. As shown in FIG. 10, the counter 13 is equipped with a gear 13_1 driven via a worm gear 39_11 which transmits the rotational drive force of the DC motor 406 (see FIG. 5). A character plate 13_5 shown in FIG. 11 is placed on top of the gear 13_1. The character plate 13_5 has a portion which displays the number "10" to "0" of remaining instant film sheets 1001 and a blank. Also, as shown in FIG. 10, the counter 13 is equipped with a spring member 13_2 which urges the gear 13_1 clockwise, a counter lever 13_3 whose tip is engaged with teeth of the gear 13_1, and a spring member 13_4 which urges the counter lever 13_3, with one end held by the counter lever 13_3 and the other end held by a member 26 shown in FIG. 11. Being configured in this way, the counter 13 turns the gear 13_1 counterclockwise by two teeth in synchronization with movement of the claw 24, and thereby increments the character plate 13_5 by 1. Since the counter 13 which counts up in synchronization with movement of the claw 24 is mounted on a plane which faces the exposure surface of the instant film sheets in the instant film pack 25 loaded in the media pack compartment 22, it is possible to increase the size of the character plate 13_5 which indicates the number of remaining instant film sheets. This makes it possible to display the number of remaining instant film sheets in large numeric characters, and thus easy to read the numeric characters which indicate the number of remaining sheets.

Figure 12:
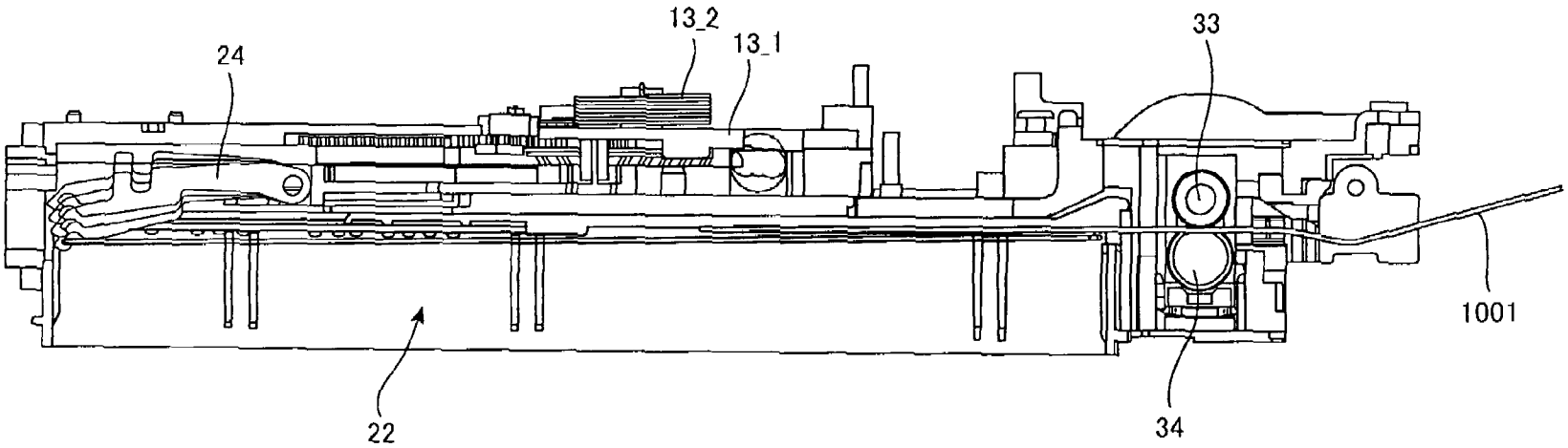
FIG. 12 is a sectional view of the printer shown in FIG. 10.

FIG. 12 is a sectional view of the printer shown in FIG. 10.

FIG. 12 shows the gear 13_1 and spring member 13_2 described above as well as the distribution rollers 33 and 34, media pack compartment 22, instant film sheet 1001 loaded in the media pack compartment 22, and claw 24. The claw 24 holds the rear end, in a transport direction, of the instant film sheet 1001 loaded in the media pack compartment 22, moves downward as shown in FIG. 12, rakes up the instant film sheet 1001 in the transport direction, and returns to an original waiting position. Details of the claw 24 will be described below with reference to FIGS. 13 and 14.

Figure 13:
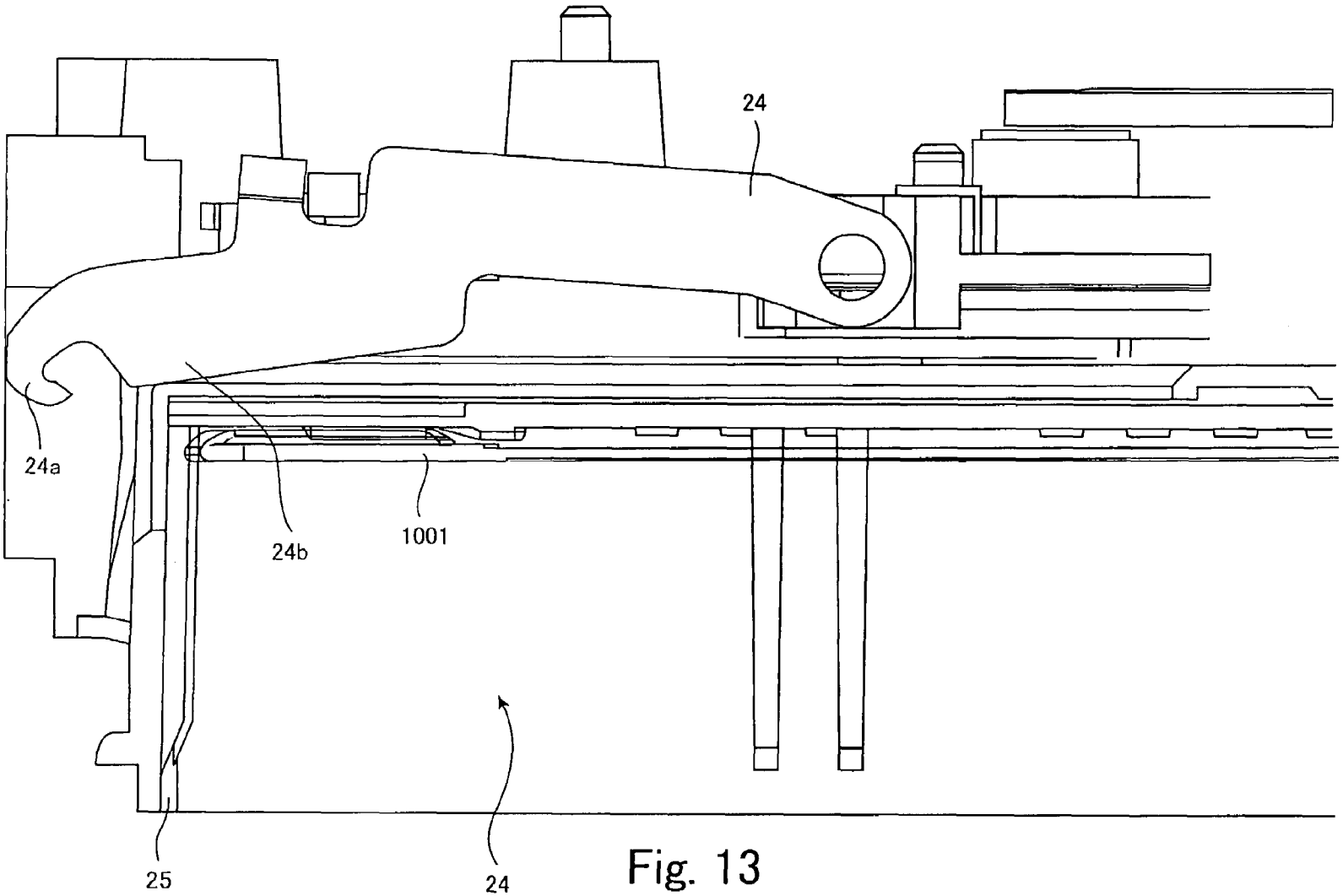
FIG. 13 is an enlarged view of a claw at its waiting position.

FIG. 13 is an enlarged view of the claw at the waiting position.

In FIG. 13, the claw 24 is installed on a plane which faces the exposure surface of the uppermost one of the instant film sheets 1001 of the printer 1 in the instant film pack 25 loaded in the media pack compartment 22, and the claw 24 has a holding section 24*a* which extends at the rear end in the transport direction of the instant film sheet 1001 loaded in the pack compartment 22. Also, the claw 24 has an abutting section 24*b*. In wait state, the holding section 24*a* of the claw 24 is located behind the end of the instant film pack 25 as shown in FIG. 13.

Figure 14:
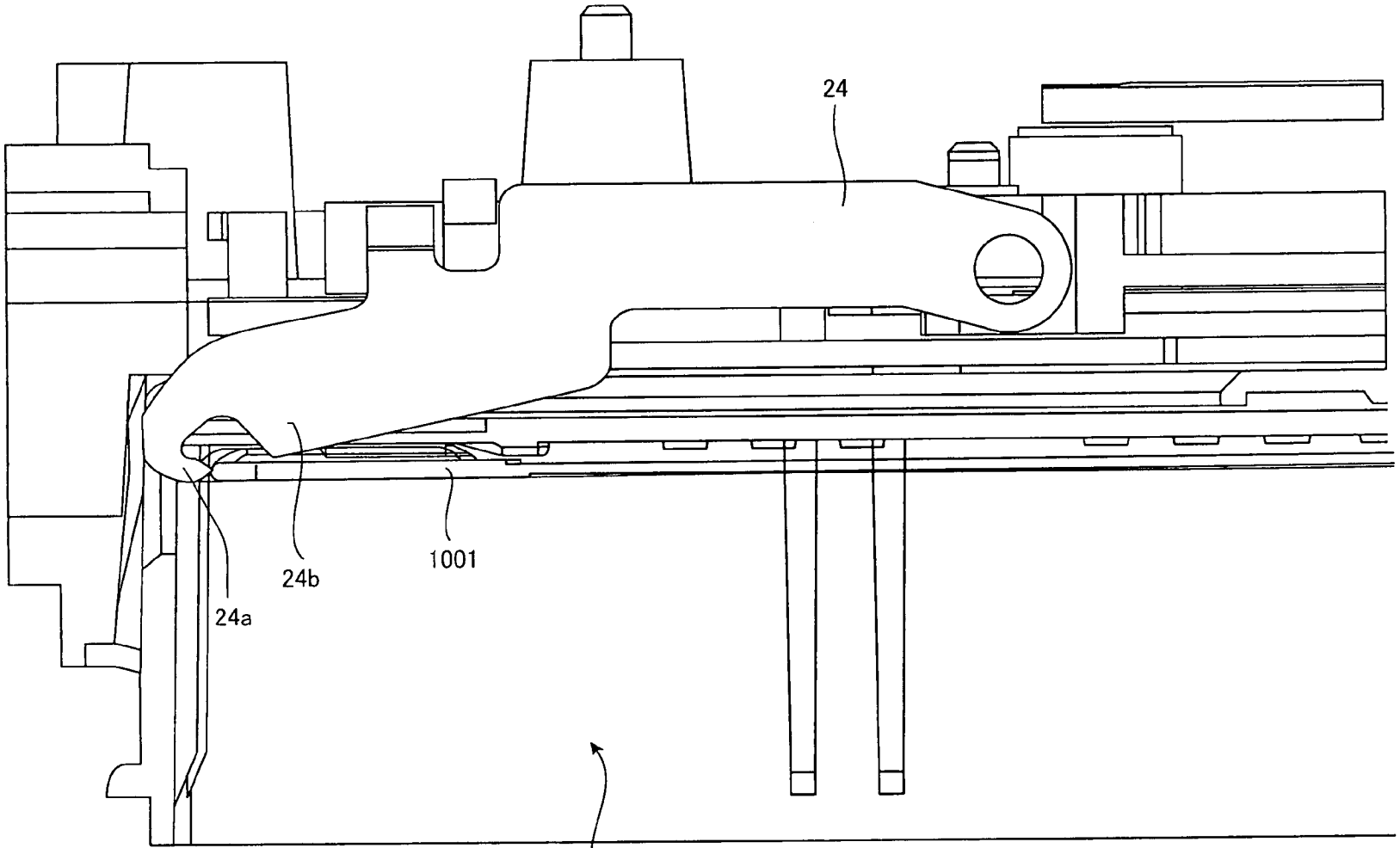
FIG. 14 is a diagram showing how the claw shown in FIG. 13 starts to rake up the instant film sheet in the transport direction.

FIG. 14 is a diagram showing how the claw shown in FIG. 13 starts to rake up the instant film sheet in the transport direction.

As the DC motor 406 rotates, the claw 24 starts to move to the right in FIG. 14, the abutting section 24*b* of the claw 24 abuts the exposure surface of the instant film sheet 1001. This allows the holding section 24*a* of the claw 24 to seize and rake up the rear end of the instant film sheet 1001 reliably. Now, a sequence of operations of the printer 1 including the raking operation of the claw 24 will be described with reference to FIG. 15 to 21.

Figure 15:
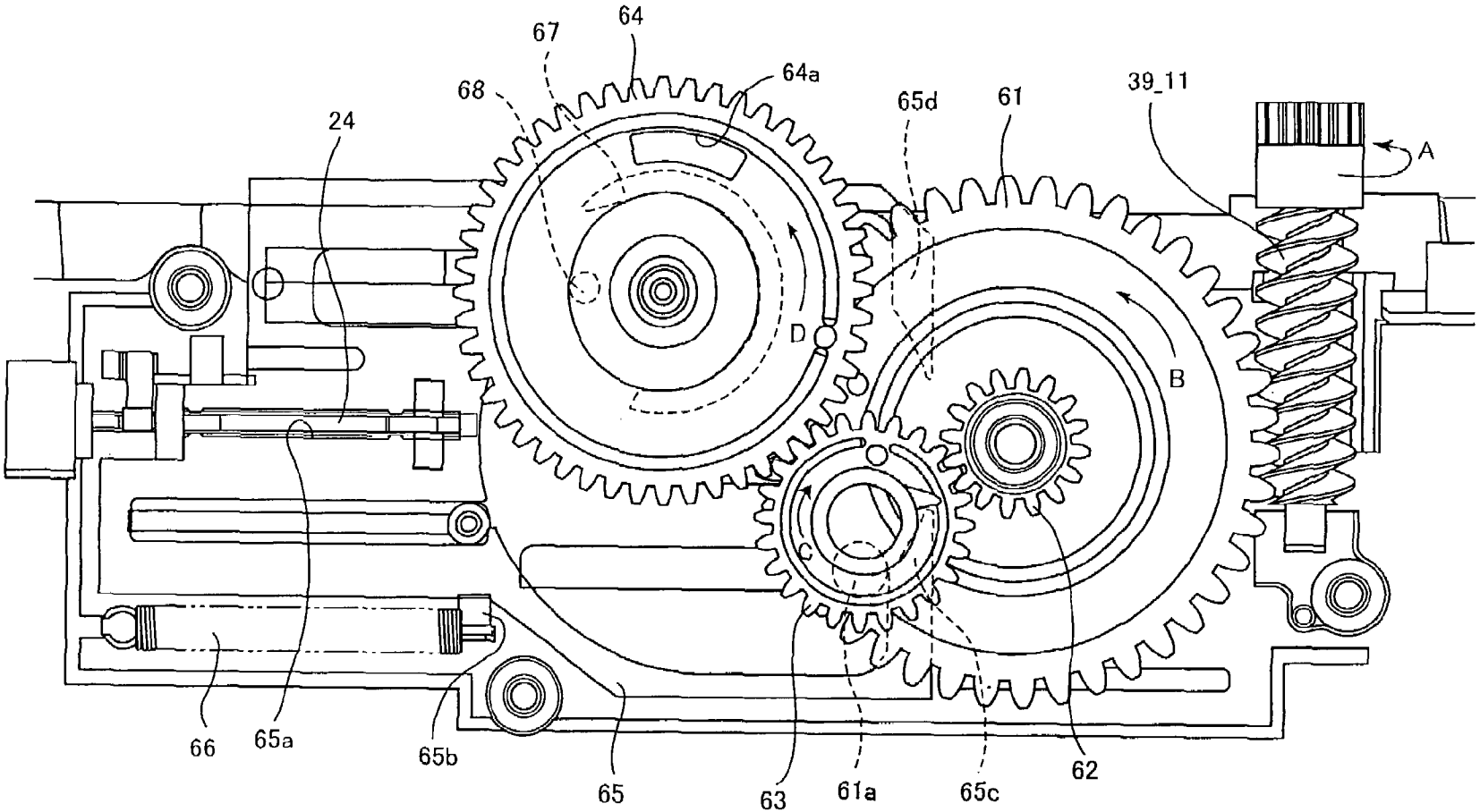
FIG. 15 is a plan view of the printer in FIG. 10 with its cover removed.

FIG. 15 is a plan view of the printer in FIG. 10 with its cover removed.

FIG. 15 shows the worm gear 39_11 which rotates in the direction of arrow A, a three-rotation cam 61 (an example of the multi-rotation cam according to the present invention) which rotates in the direction of arrow B under the rotational drive force of the worm gear 39_11, a gear 62 which rotates along with the three-rotation cam 61, a gear 63 which rotates in the direction of arrow C in mesh with the gear 62, and a single-rotation cam 64 which rotates in the direction of arrow D under the rotational drive force of the gear 63. The three-rotation cam 61 rotates three times while the single-rotation cam 64 makes a single rotation. An engaging member 61*a* is provided on the rear face of the three-rotation cam 61. On the other hand, the single-rotation cam 64 completes a sequence of transport operations by one rotation. Also, the single-rotation cam 64 has a hole 64*a* which receives a cam switch 404 (see FIG. 6) used to monitor the initial position of the sequence.

FIG. 15 also shows a claw plate 65 and a spring member 66 which urges the claw plate 65 to the left in FIG. 15. A straight guide groove 65*a* is provided in the claw plate 65 to guide the claw 24. A holding member 65*b* is installed on the claw plate 65 to hold the spring member 66. Also, the claw plate 65 has heads 65*c* and 65*d* which are engaged with the engaging member 61*a* provided on the rear face of the three-rotation cam 61.

Furthermore, FIG. 15 shows a half-moon cam member 67 installed on the reverse side of the single-rotation cam 64 and a cam follower member 68 which is installed on the claw plate 65 and slides over the cam member 67.

FIG. 15 shows a state which occurs just before the claw 24 begins a raking motion. In this state, the engaging member 61*a* of the three-rotation cam 61 is engaged with the head 65*c* of the claw plate 65. On the other hand, the cam follower member 68 does not slide over the cam member 67.

Now, the wormgear 39_11 starts to rotate. Consequently, the three-rotation cam 61 starts to rotate in the direction of arrow B. Since the head 65*c* of the claw plate 65 is engaged with the engaging member 61*a* of the three-rotation cam 61, the claw plate 65 starts to ascend toward the worm gear 39_11.

Figure 16:
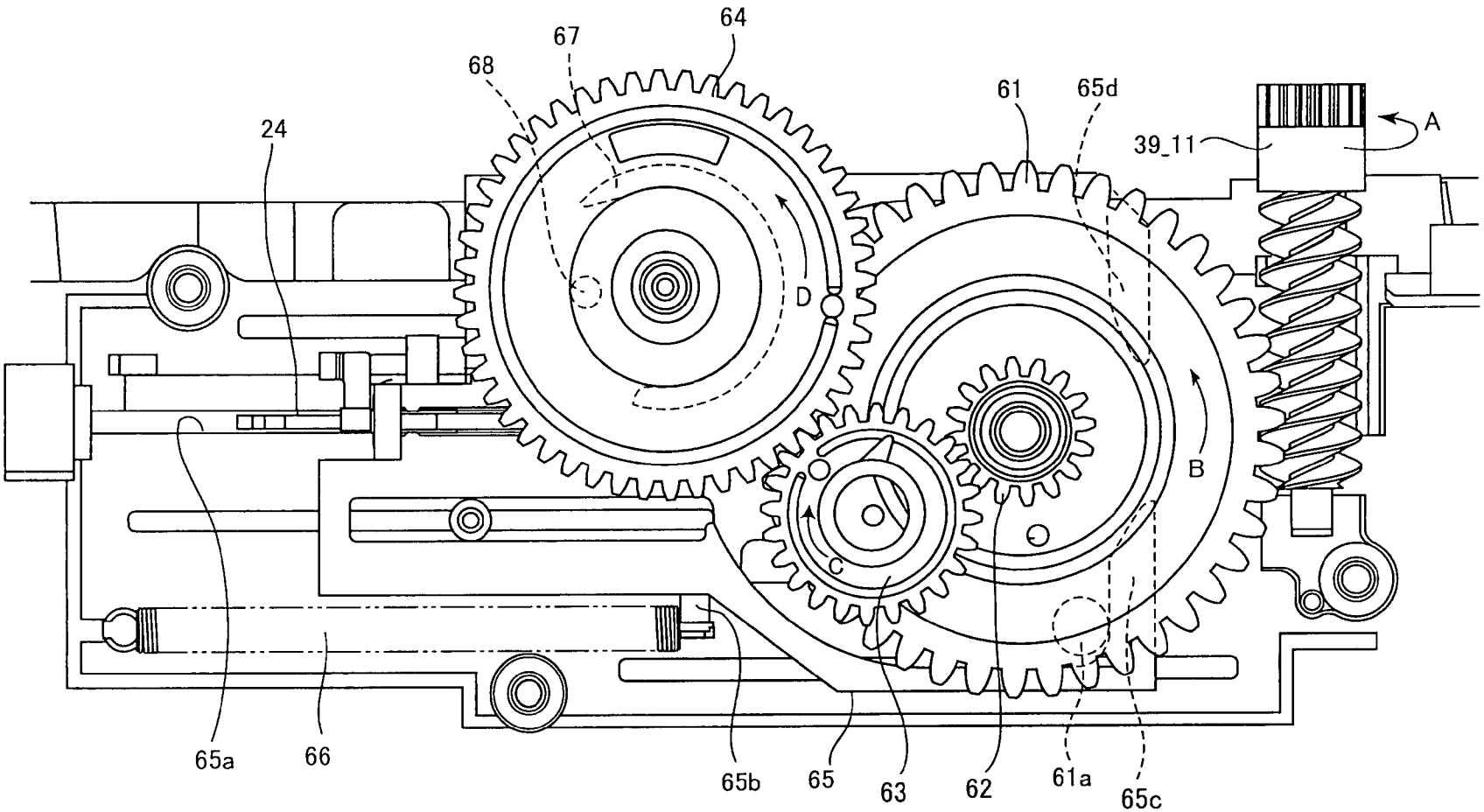
FIG. 16 is a diagram showing a state which occurs when the claw plate starts to ascend.

FIG. 16 is a diagram showing a state which occurs when the claw plate starts to ascend.

As described above, when the claw plate 65 starts to ascend, so does the claw 24, being guided by the holding member 65*a* installed on the claw plate 65. Consequently, the instant film sheet 1001 starts to be raked up. Incidentally, the single-rotation cam 64 rotates in the direction of arrow D by the amount ⅓ that of the three-rotation cam 61 via the gears 62 and 63. The cam member 67 also rotates in the direction of arrow D accordingly.

Figure 17:
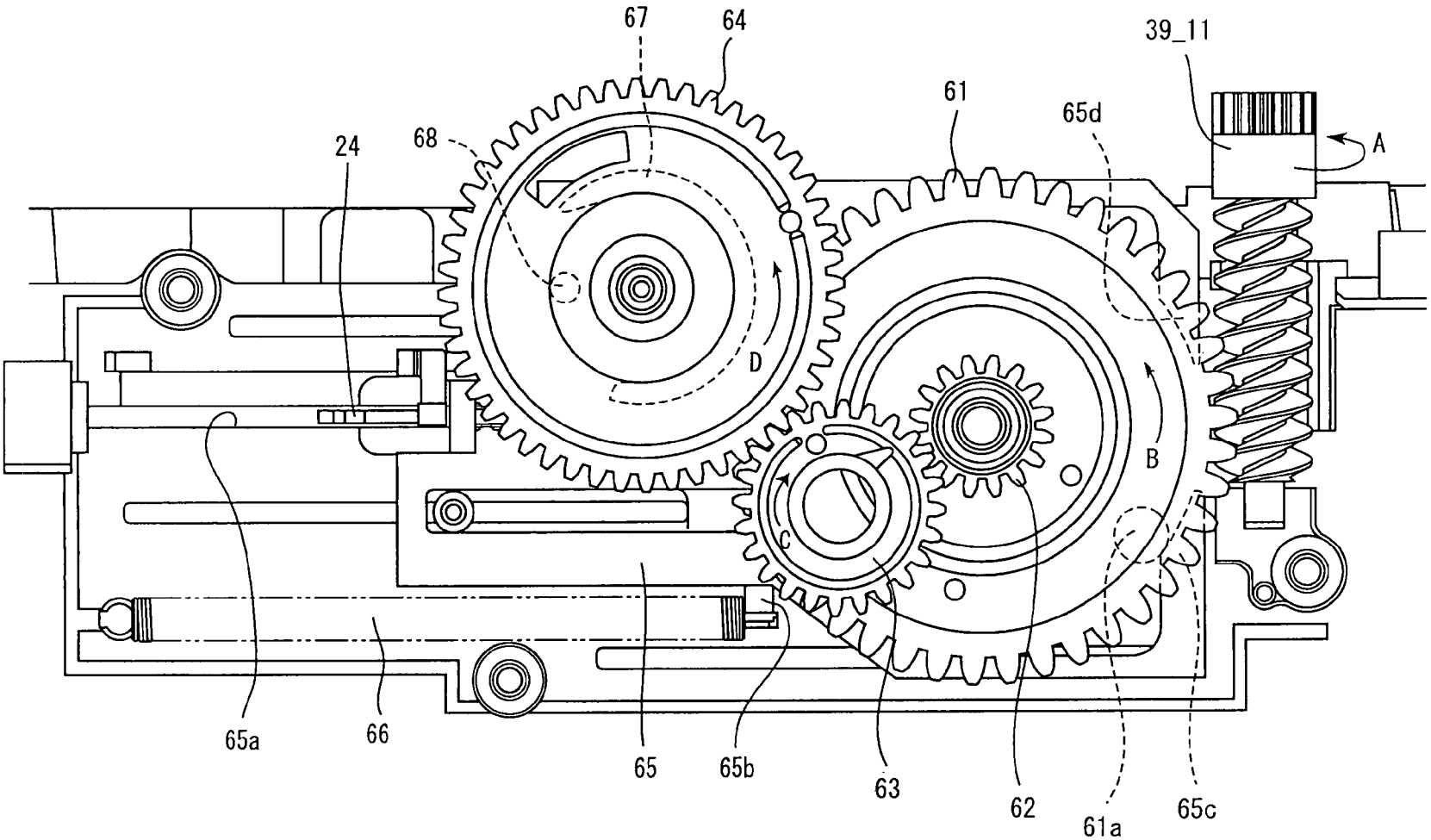
FIG. 17 is a diagram showing a state which occurs when the claw plate ascends further.

FIG. 17 is a diagram showing a state which occurs when the claw plate ascends further.

The three-rotation cam 61 further rotates in the direction of arrow B and the claw plate 65 ascends almost to the highest point. Consequently, the claw 24 almost reaches its own highest point as well. The single-rotation cam 64 rotates in the direction of arrow D by the amount ⅓ that of the three-rotation cam 61 via the gears 62 and 63. The cam member 67 further rotates in the direction of arrow D as well accordingly.

Figure 18:
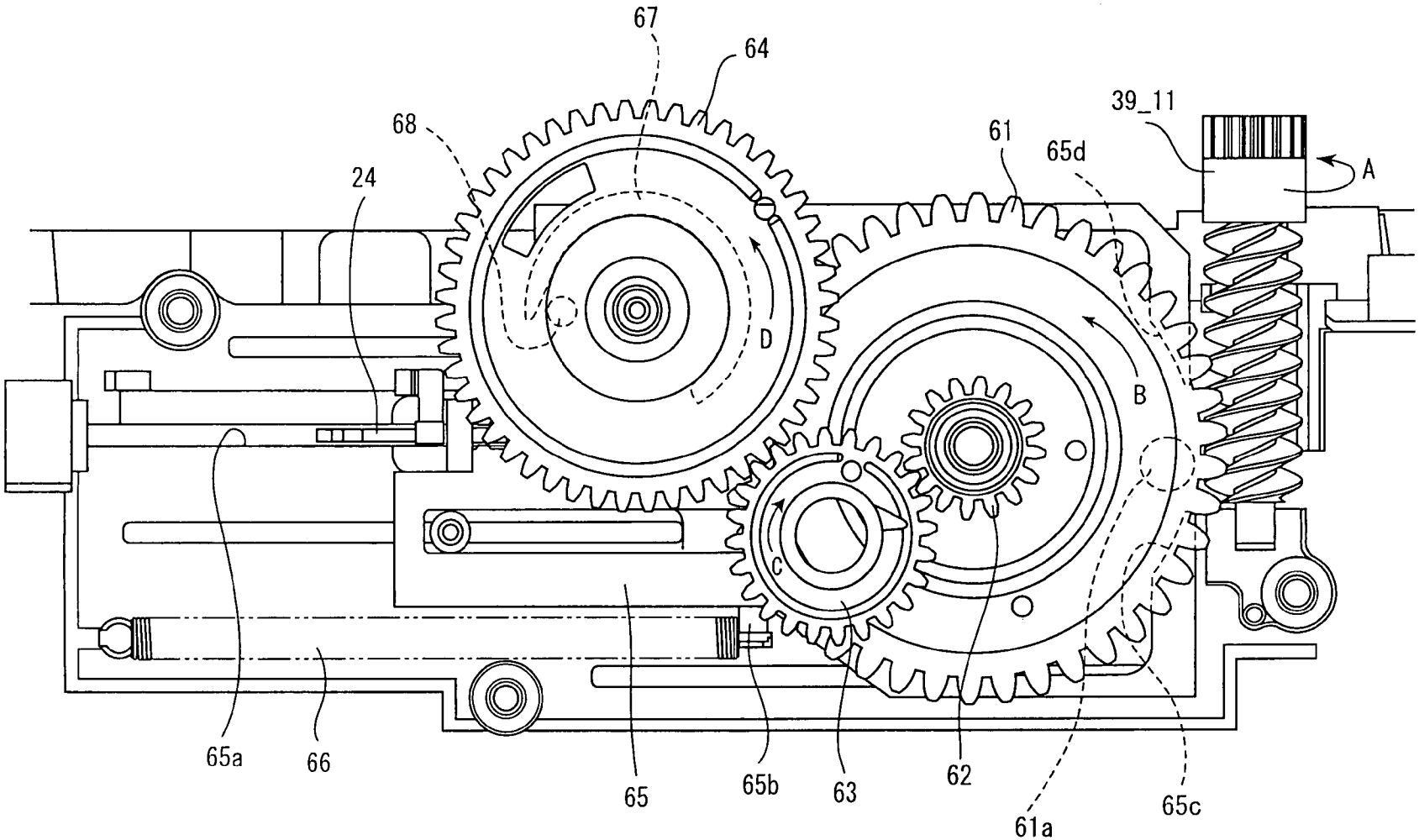
FIG. 18 is a diagram showing a state which occurs when the claw plate reaches the highest point.

FIG. 18 is a diagram showing a state which occurs when the claw plate reaches the highest point.

As the three-rotation cam 61 rotates further, the claw plate 65 reaches the highest point. Consequently, the cam follower member 68 starts to slide over the cam member 67 installed on the reverse side of the single-rotation cam 64. On the other hand, the engaging member 61*a* provided on the rear face of the three-rotation cam 61 leaves the head 65*c*. In this way, even when the engaging member 61*a* leaves the head 65*c*, since the cam follower member 68 descends gradually along the cam member 67, the claw plate 65 is kept from being returned downward rapidly by the spring member 66.

Figure 19:
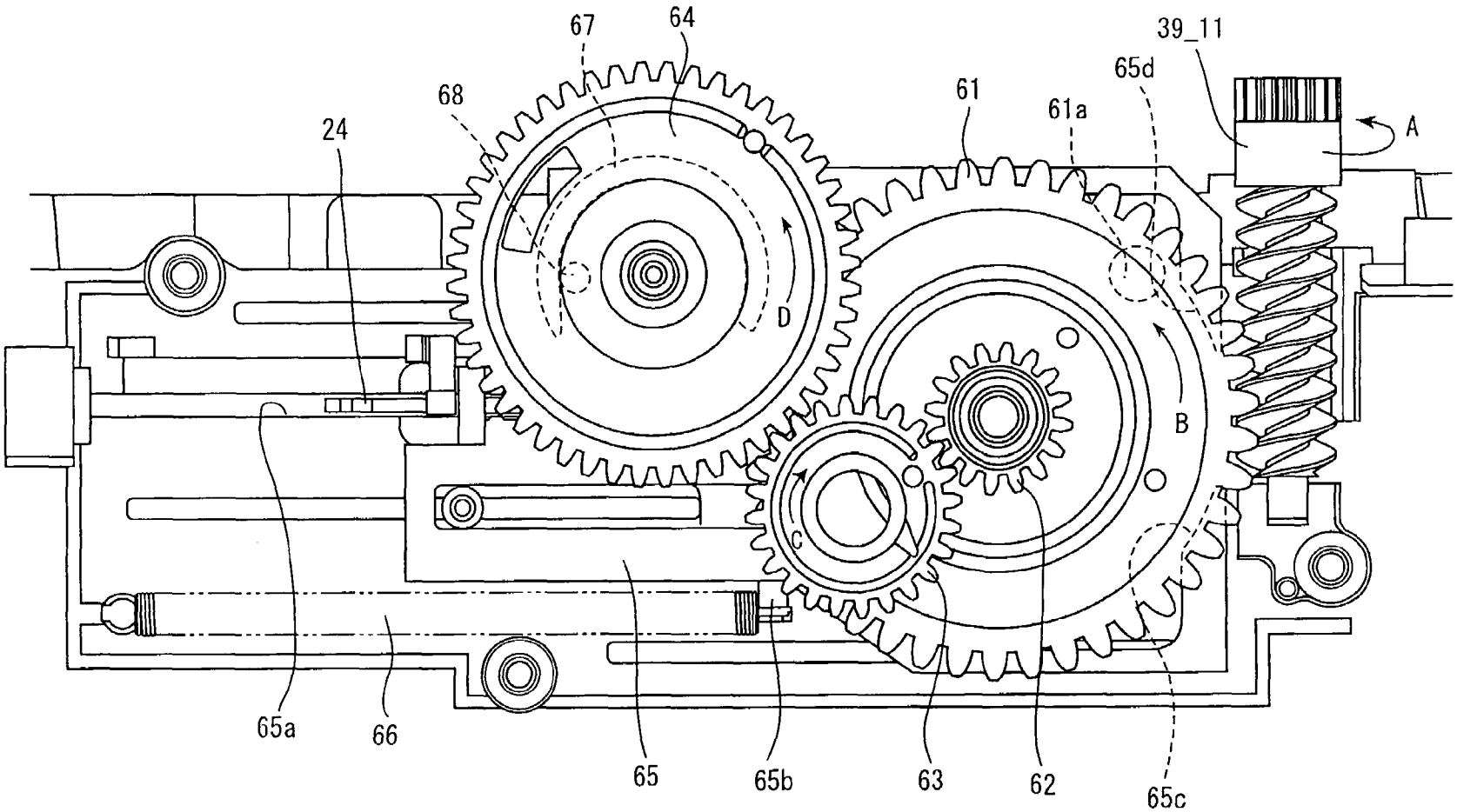
FIG. 19 is a diagram showing a state which occurs when the claw plate is being returned to its waiting position after reaching the highest point.

FIG. 19 is a diagram showing a state which occurs when the claw plate is being returned to its waiting position after reaching the highest point.

As the three-rotation cam 61 rotates further with the cam follower member 68 kept sliding over the cam member 67, the engaging member 61*a* engages, this time, with the head 65*d* of the claw plate 65. The sequence of operations goes in this way.

Figure 20:
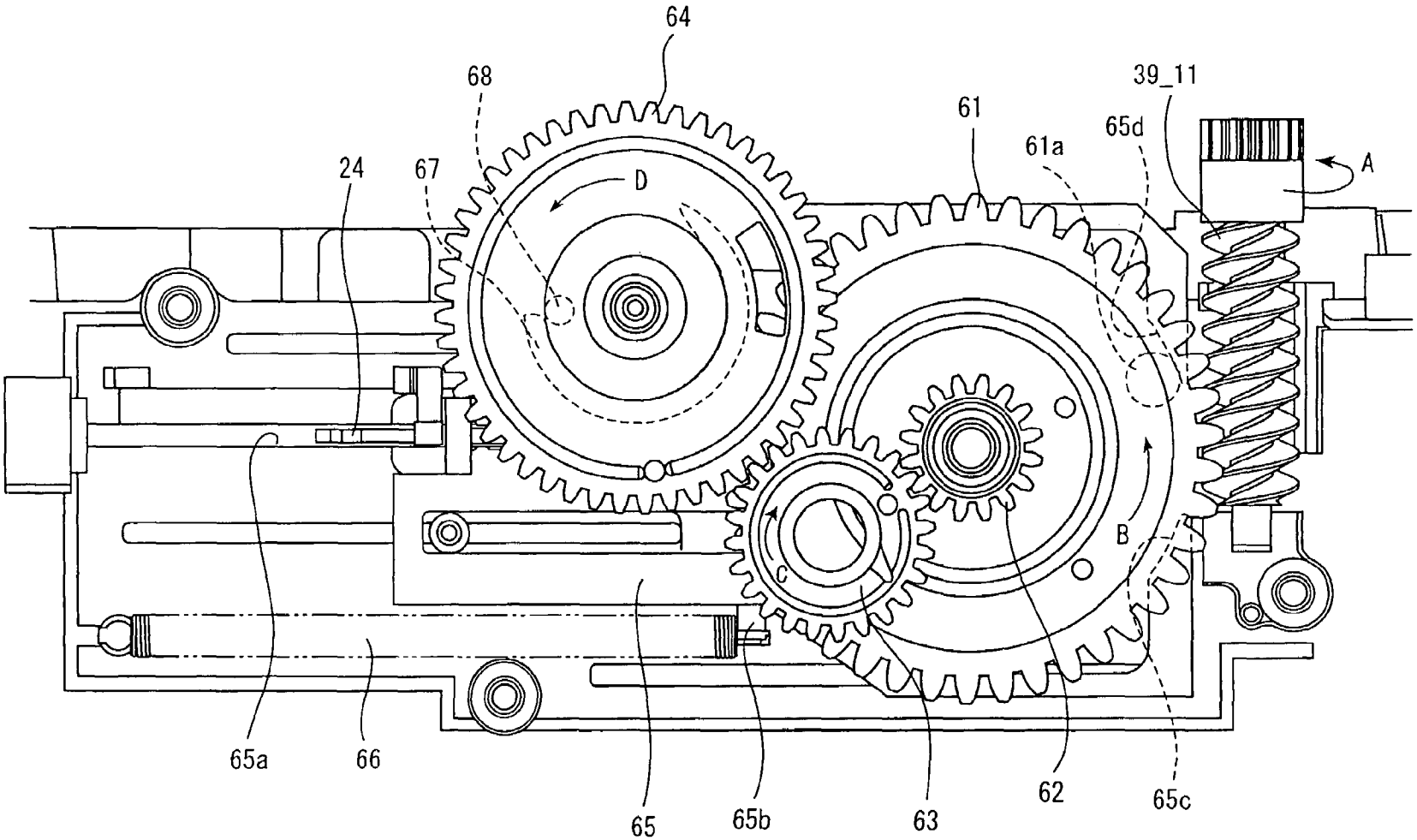
FIG. 20 is a diagram showing a state which occurs when a three-rotation cam is making its third rotation.

FIG. 20 is a diagram showing a state which occurs when the three-rotation cam is making its third rotation.

When the three-rotation cam 61 makes its third rotation, the cam follower member 68 is leaving the cam member 67. On the other hand, the engaging member 61*a* is engaged with the head 65*d* of the claw plate 65.

Figure 21:
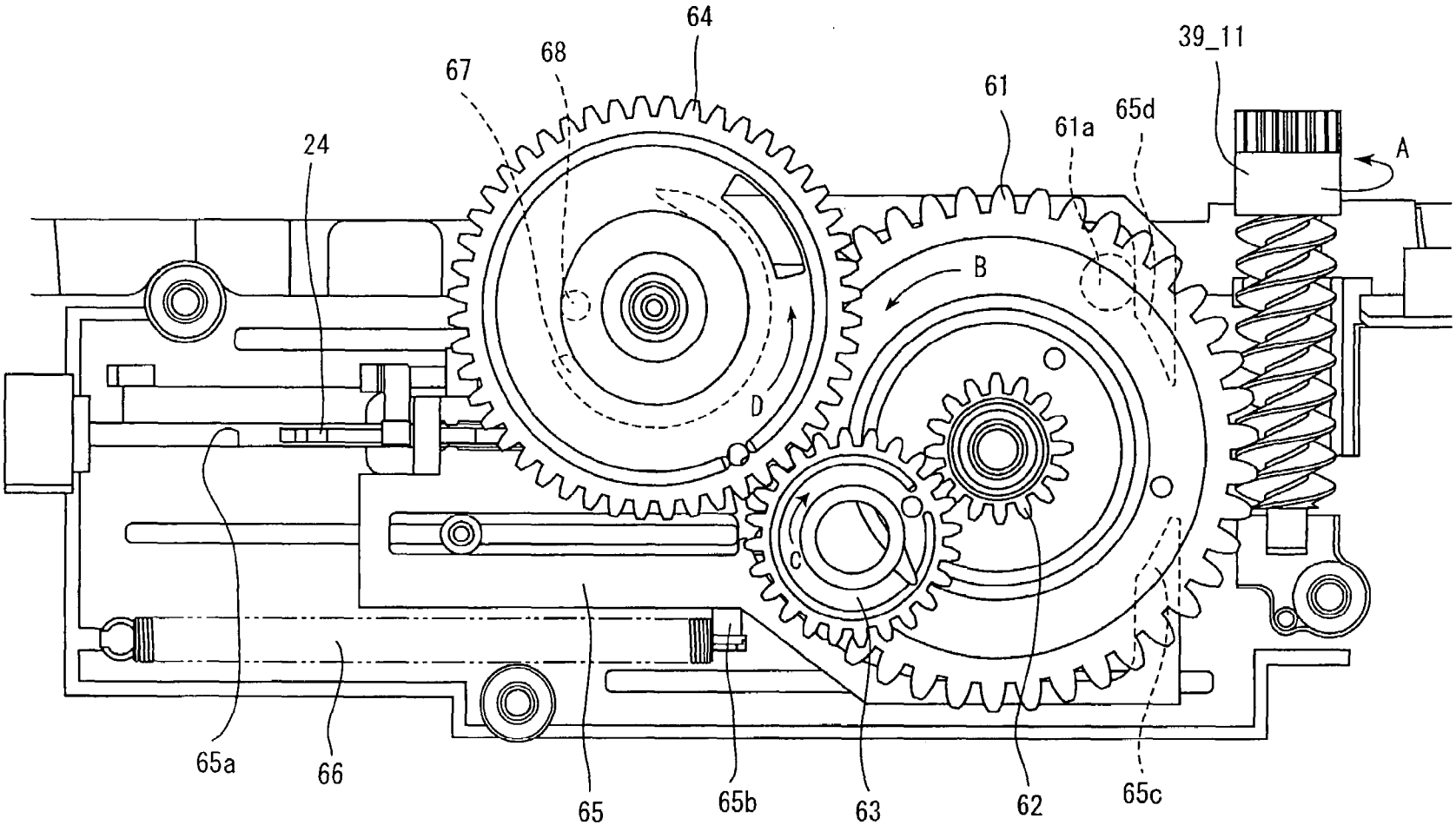
FIG. 21 is a diagram showing a state which occurs when the three-rotation cam is finishing its third rotation.

FIG. 21 is a diagram showing a state which occurs when the three-rotation cam is finishing its third rotation.

When the three-rotation cam 61 is finishing its third rotation, although the cam follower member 68 is disengaged from the cam member 67, the engaging member 61*a* is engaged with the head 65*d* of the claw plate 65. Consequently, the claw plate 65 descends gradually, without being returned downward rapidly by the spring member 66. This ends the sequence of operations and consequently an image is recorded on the instant film sheet 1001.

In the printer 1 according to the present embodiment, since the claw 24 is installed on a plane which faces the exposure surface of the uppermost one of the instant film sheets 1001 in the instant film pack 25 loaded in the media pack compartment 22, and the claw 24 has a holding section 24*a* which extends at the rear end in the transport direction of the instant film sheet 1001, the three-rotation cam 61, single-rotation cam 64, claw plate 65, etc. with relatively large areas can be installed on a plane which faces the exposure surface of the instant film sheet 1001. Thus, compared to the conventional technique of installing the mechanical section including a claw and cams on a side of the media pack compartment, the present invention can reduce the thickness of the printer 1.

What is claimed is:

1. A printer which records images on a recording medium by writing the images on the recording medium on which the images are to be recorded, while transporting the recording medium in a predetermined transport direction, comprising:

a media pack compartment loaded with a media pack which contains multiple sheets of the recording medium stacked together;

a claw which holds the rear end, in a transport direction, of a sheet of the recording medium loaded in the media pack compartment, rakes up the sheet of the recording medium in the transport direction, and returns to an original waiting position; and a transport roller which takes over transport of the recording medium raked up by the claw;

wherein the claw is installed on a plane which faces a surface of the recording medium contained in the media pack loaded in the media pack compartment and is equipped with a holding section which extends from the plane at the rear end, in the transport direction, of the sheet of the recording medium loaded into the media pack compartment and holds the rear end of the sheet of the recording medium; and further comprising a single-rotation cam which is installed on the same side as the plane and completes a sequence of transport operations by a single-rotation and a multi-rotation cam which rotates multiple times while the single-rotation cam makes a single rotation, wherein the raking motion of the claw is caused by the multi-rotation cam.

2. A printer which records images on a recording medium by writing the images on the recording medium on which the images are to be recorded, while transporting the recording medium in a predetermined transport direction, comprising:

a media pack compartment loaded with a media pack which contains multiple sheets of the recording medium stacked together;

a claw which holds the rear end, in a transport direction, of a sheet of the recording medium loaded in the media pack compartment, rakes up the sheet of the recording medium in the transport direction, and returns to an original waiting position; and a transport roller which takes over transport of the recording medium raked up by the claw;

wherein the claw is installed on a plane which faces a surface of the recording medium contained in the media pack loaded in the media pack compartment and is equipped with a holding section which extends from the plane at the rear end, in the transport direction, of the sheet of the recording medium loaded into the media pack compartment and holds the rear end of the sheet of the recording medium; and further comprising a ratchet type counter which is installed on the same side as the plane and counts up on synchronization with movement of the claw or the multi-rotation cam.

* * * * *